US010697723B1

(12) United States Patent
Hall

(10) Patent No.: US 10,697,723 B1
(45) Date of Patent: Jun. 30, 2020

(54) SHOTGUN CHARGER

(71) Applicant: Kelly Hall, Portland, OR (US)

(72) Inventor: Kelly Hall, Portland, OR (US)

( * ) Notice: Subject to any disclaimer, the term of this patent is extended or adjusted under 35 U.S.C. 154(b) by 0 days.

(21) Appl. No.: 16/726,745

(22) Filed: Dec. 24, 2019

(51) Int. Cl.

| | |
|---|---|
| ***F41A 9/83*** | (2006.01) |
| ***F41A 9/18*** | (2006.01) |
| ***F41C 7/02*** | (2006.01) |
| *F41A 9/72* | (2006.01) |

(52) U.S. Cl.
CPC ..... *F41A 9/18* (2013.01); *F41C 7/02* (2013.01); *F41A 9/72* (2013.01)

(58) Field of Classification Search
CPC ..... F41A 9/83; F41A 9/82; F41A 9/18
USPC ..... 42/87
See application file for complete search history.

(56) References Cited

U.S. PATENT DOCUMENTS 618,369 A 1/1899 Wilson
810,310 A 1/1906 Sparks
2,865,126 A 12/1958 Dardick
4,416,076 A 11/1983 Ottolini
4,509,284 A * 4/1985 Naber ..... F41A 9/83 42/87
4,679,486 A 7/1987 Landaas
4,720,931 A * 1/1988 Jensen ..... F41A 9/83 42/87
4,756,110 A * 7/1988 Beltron ..... F41A 9/83 42/87
4,862,621 A * 9/1989 Kearney ..... F41A 9/83 42/87
4,867,039 A 9/1989 Dobbins
4,882,973 A 11/1989 Piscetta
(Continued)

OTHER PUBLICATIONS

"Kel-Tec KSG," downloaded from https://en.wikipedia.org/w/index.php?title=Kel-Tec KSG&oldid=898159003, 2 pp. (May 21, 2019).
(Continued)

*Primary Examiner* — Reginald S Tillman, Jr.
(74) *Attorney, Agent, or Firm* — Klarquist Sparkman, LLP

(57) ABSTRACT

A charger for a firearm comprises a body, a movable internal diverter and an advancing member. The body has at least first and second cartridge holding areas that are arranged parallel to each other and are configured to receive and store cartridges in an end-to-end orientation. A first end of the body has a cartridge opening through which cartridges can be loaded into and unloaded from the charger and a receiver insert shaped to fit into a receiver of the firearm. The movable internal diverter is positioned in the body and extends at least partway between the first and second cartridge holding areas to separate the first and second cartridge holding areas from each other. The advancing member is accessible from an exterior of the body and has an engaging member extending within the body and configured to contact a cartridge in one of the first and second cartridge holding areas. The advancing member is movable toward the first end in an advancement direction to urge cartridges from a selected one of the first and second cartridge holding areas and out of the cartridge opening, and in a reverse direction toward a second end of the body to withdraw the engaging member and move the internal diverter so that the engaging member is aligned with the other of the first and second holding areas.

20 Claims, 6 Drawing Sheets

(56) References Cited

U.S. PATENT DOCUMENTS

| | | | | |
|---|---|---|---|---|
| 4,905,395 | A | 3/1990 | Wagner | |
| 5,367,810 | A | 11/1994 | Stead et al. | |
| 6,135,005 | A | 10/2000 | Dobbins | |
| 6,185,853 | B1 * | 2/2001 | Sniezak | F41A 9/83 42/87 |
| 6,250,194 | B1 | 6/2001 | Brandl et al. | |
| 7,866,080 | B2 * | 1/2011 | Tucker | F41A 9/83 42/87 |
| 9,015,979 | B2 | 4/2015 | Safewright, Jr. | |
| 2004/0020093 | A1 | 2/2004 | Hajjar et al. | |
| 2007/0240352 | A1 | 10/2007 | Pullicar | |
| 2010/0269389 | A1 | 10/2010 | Lopez Laparra | |
| 2010/0313460 | A1 | 12/2010 | Tucker | |
| 2013/0081314 | A1 | 4/2013 | Hatfield | |
| 2019/0120604 | A1 | 4/2019 | Partanen | |

OTHER PUBLICATIONS

"UTAS UTS-15," downloaded from https://en.wikipedia.org/w/index.php?title=UTAS UTS-15&oldid=895603986, 3 pp. (May 5, 2019).

* cited by examiner

SHOTGUN CHARGER

BACKGROUND

Some firearms, such as semi-automatic shotguns, have tubular magazines extending parallel to the shotgun's barrel capable of accommodating a selected number of shotgun shells within the shotgun. These magazines are typically designed to be reloaded one shotgun shell at a time, which can be time consuming and lead to dropped shotgun shells.

There are shotgun chargers (also sometimes referred to as autoloaders) that have been designed in an effort to reduce the time and number handling steps in reloading a shotgun's tubular magazine.

Conventional shotgun chargers may have an extended length that makes them difficult or inconvenient to carry on a person and access while also carrying a shotgun. In addition, conventional shotgun chargers may require two hands to hold the charger in contact with the shotgun and to operate it to unload shells from the charger into the shotgun, which is inconvenient.

SUMMARY

Described below are implementations of a shotgun charger that addresses at least some of the drawbacks of current shotgun chargers.

In some implementations, a charger for a firearm comprises a body, a movable internal diverter and an advancing member. The body has at least first and second cartridge holding areas that are arranged parallel to each other and are configured to receive and store cartridges in an end-to-end orientation. A first end of the body has a cartridge opening through which cartridges can be loaded into and unloaded from the charger, and a receiver insert shaped to fit into a receiver of the firearm. The movable internal diverter is positioned in the body and extends at least partway between the first and second cartridge holding areas to separate the first and second cartridge holding areas from each other. The advancing member is accessible from an exterior of the body and has an engaging member extending within the body and configured to contact a cartridge in one of the first and second cartridge holding areas. The advancing member is movable toward the first end in an advancement direction to urge cartridges from a selected one of the first and second cartridge holding areas and out of the cartridge opening, and in a reverse direction toward a second end of the body to withdraw the engaging member and move the internal diverter so that the engaging member is aligned with the other of the first and second holding areas.

In some implementations, the internal diverter is spring-biased. For example, there may be at least one torsion spring configured to apply a biasing force to the internal diverter to move the internal diverter when the engagement member is fully retracted. The charger can comprise a contact paddle coupled to the torsion spring and configured to contact the internal diverter. There can be a guide coupled to the internal diverter that is configured to guide the internal diverter as the internal diverter is moved relative to the contact paddle. The internal diverter can be keyed to the housing for guided movement by at least one projection extending into a slot formed in the housing. There can be at least one projection is manually actuatable from outside the housing to move the internal diverter.

In some implementations, the receiver insert is configured to exert a biasing force to retain the charger in position relative to the receiver of the firearm. In some implementations, the receiver insert can comprise a forward end in which the cartridge opening is defined and an opposite rear end fitted with a resilient retainer configured to resiliently deform and provide a holding force. In some implementations, the receiver insert can comprise an extension extending from the forward end, and the extension is configured to engage a recess within the firearm.

In some implementations, the first end of the receiver insert is shaped to be engaged with a front edge of a bottom opening of the receiver and pivoted rearwardly to move the rear end and resilient retainer into engagement with a rear edge of the receiver opening.

In some implementations, the advancing member is configured to be coupled to an exterior of the body. The advancing member can be configured to have a first side, a front side and a second side opposite the first side. The advancing member can be configured to have a U-shaped cross-section. The body can have an external track shaped to receive and guide the advancing member.

In some implementations, the first and second cartridge holding areas are dimensioned to hold shotgun shells of a selected shotgun shell gauge. In some implementations, the first and second holding areas define shotgun shell positions along respective first and second loading paths extending at an angle transverse to the receiver. In some implementations, the loading paths curve from a steeper transverse angle near a second end of the body to a shallower transverse angle near the first end of the body.

In some implementations, the body has at least one slot, and the advancing member has a projecting member shaped to engage and travel within the slot as the engaging member is moved in the advancement direction and the reverse direction.

In some implementations, the body has at least one transparent portion to provide a visual inspection area through which a user can view an interior of the charger.

The foregoing and other objects, features, and advantages of the invention will become more apparent from the following detailed description, which proceeds with reference to the accompanying figures.

DETAILED DESCRIPTION

Figure 1:
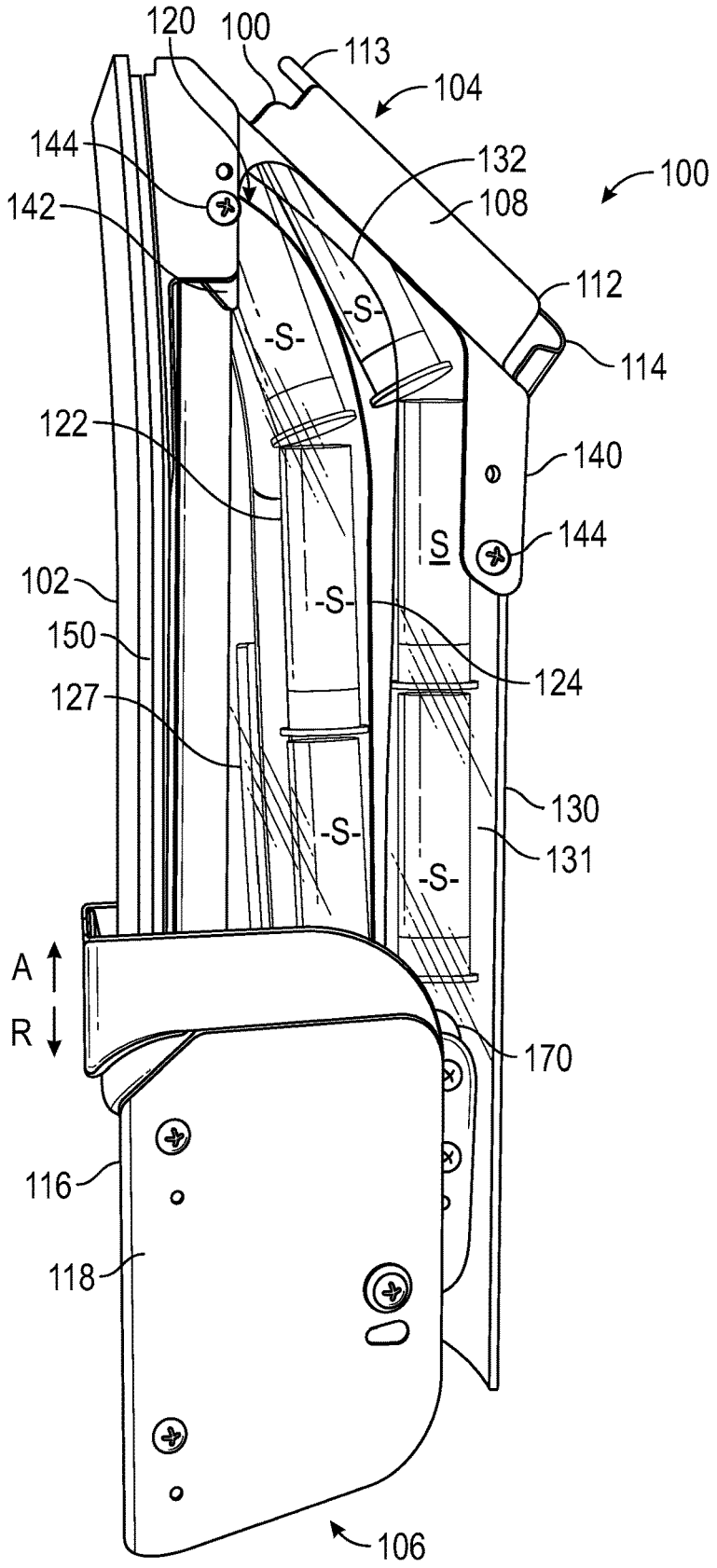
FIG. 1 is a side elevation view of one implementation of the shotgun charger.

Described below are implementations of a shotgun charger used to store shotgun shells and load them into a shotgun shell tube (magazine) of a shotgun. Unlike an external magazine, the shotgun shell charger is not intended to remain attached to the shotgun while the shotgun is being carried or fired. Rather, after the charger is used to load shotgun shells into the shotgun, it is then removed and carried or stored separately from the shotgun for a future use.

Although described as a shotgun charger, the same principles described herein can be applied to provide a charger or autoloader for other types of firearm cartridges, such as rifle cartridges, pistol cartridges and/or other types of cartridges for use with those respective types of firearms.

Referring to FIGS. 1-6, a shotgun charger 100 has a generally elongate body 102 with a first end 104 and a generally opposite second end 106. The first end 104 is designed to be coupled with or attached to a firearm. In the illustrated implementation, the first end 104 has a receiver insert 108 that is shaped to be inserted into a receiver 180 of a shotgun F (FIG. 4), such as via a bottom opening 182 of the receiver 180, as is described below in greater detail.

Figure 2:
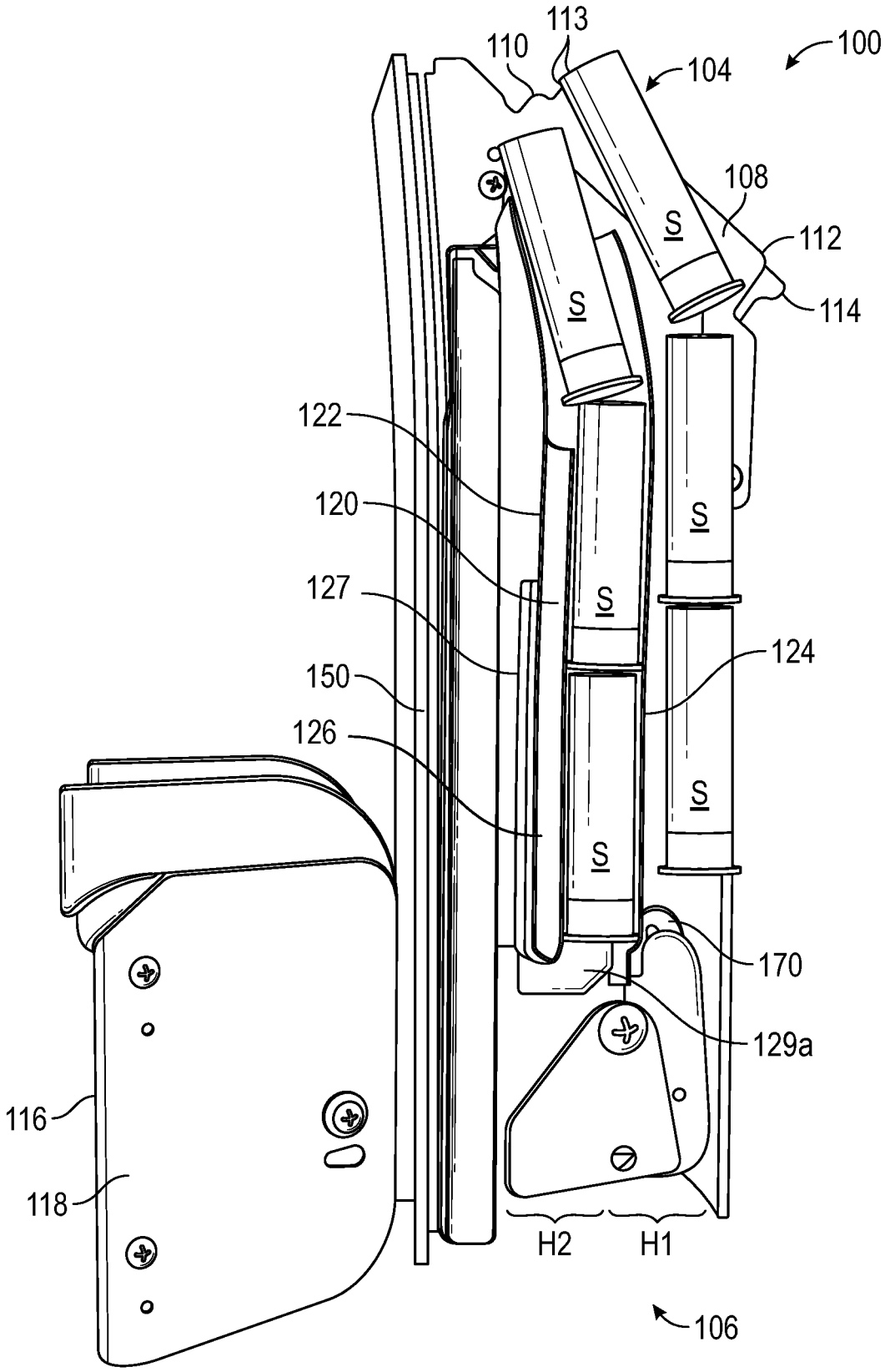
FIG. 2 is a side elevation view of the shotgun charger of FIG. 1 shown in a partially disassembled state with the advancing member removed and positioned to the left of the body and the side cover member removed.

Within the body 102 of the charger 100, multiple shotgun shells (cartridges) S can be housed end-to-end within multiple holding areas that are arranged side-by-side. In the illustrated implementation, as best seen in FIG. 2, there is a first area H1 with three shells S, and an adjacent second area H2, also with three shells S. The first and second areas H1, H2 are separated from each other by a movable diverter 120. In the illustrated embodiment, an advancing member 116 is manually moved to load shells S from the charger 100 into the shotgun F. The shells from the first area H1 are loaded into the firearm first (thus, the shells from the first area H1 are moved out of the charger 100 first).

The body 102 of the charger 100 can include a housing 130 comprised of one or more sides or members. The housing can have a solid construction. In the illustrated implementation, the housing 130 can include at least one transparent side or portion thereof, i.e., a transparent side cover member 131, for greater visibility of the internal components. The transparent or translucent portion can also be configured as a partial "window" or panel in an adjacent or surrounding solid member. In other implementations, the side cover 131 is made of an opaque or translucent material.

The side cover member 131 has a slot 132 that is engaged by a projection (e.g., a threaded sleeve 133) on an inner side of an advancing member 116, which is described below in greater detail. In FIG. 2, the side cover member 131 has been removed, and the advancing member 116 is shown disassembled from the body and moved to one side, to allow interior details of the shotgun charger 100 to be viewed.

Referring again to FIG. 1, the advancing member 116 is shown positioned to be advanced, i.e., it is in its fully retracted position and is ready to be moved in translation in the direction A relative to the body 102, to move shells S in the first area H1 out of the charger 100. As the advancing member 116 is moved in the direction A, an engaging member 170 coupled to the advancing member 116 pushes an end of the last shell S in the area H1, and in turn urges the other shells S in the area H1 in the direction A. With continued advancement in the direction A, a first of the shells S in the area H1 is eventually urged out of the receiver insert 108 through its front end 110 and into the shotgun F. Further advancement causes the remaining shells in the area H1 to be moved into the shotgun F.

Figure 3:
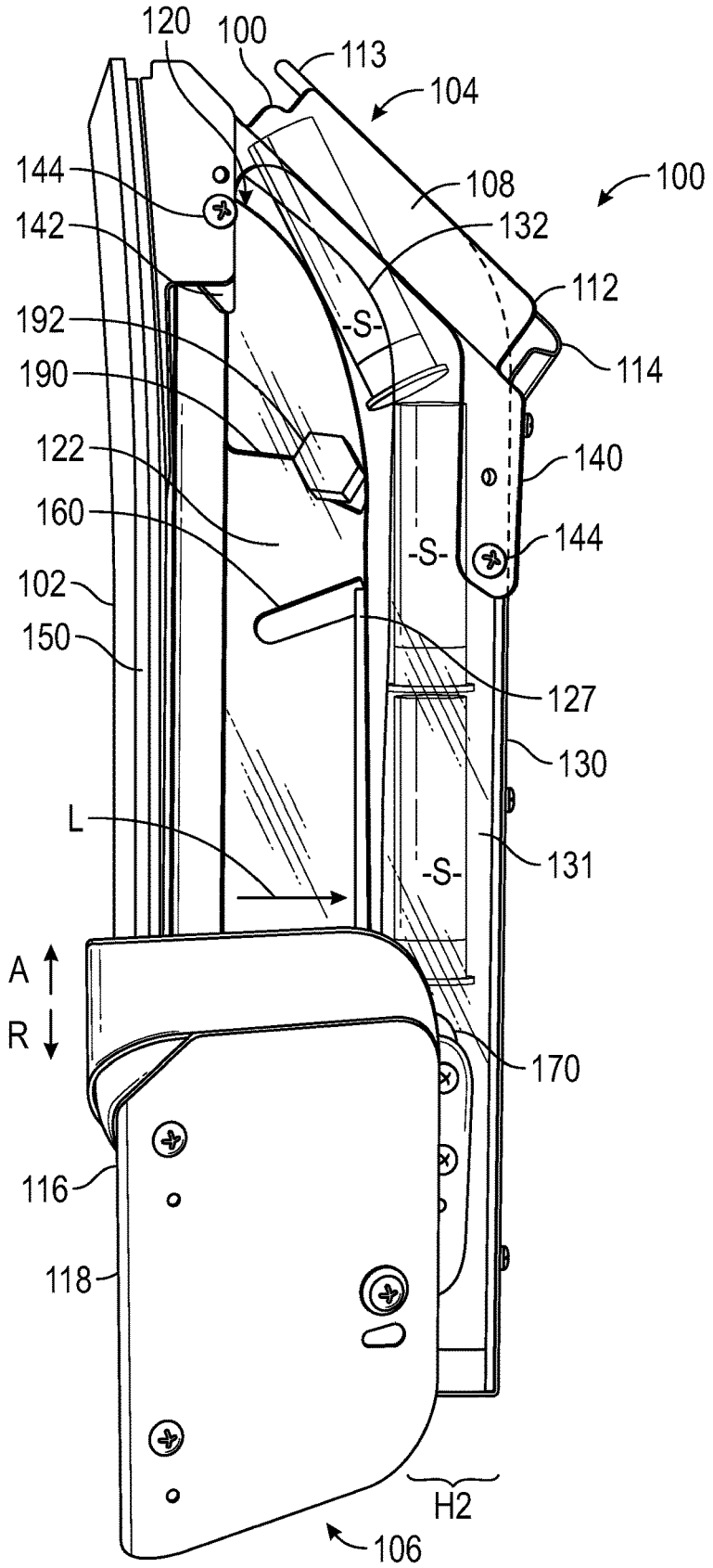
FIG. 3 is a side elevation view of the shotgun charger of FIG. 1 in use after the advancing member has been advanced and returned to its retracted position as shown.
Figure 4:
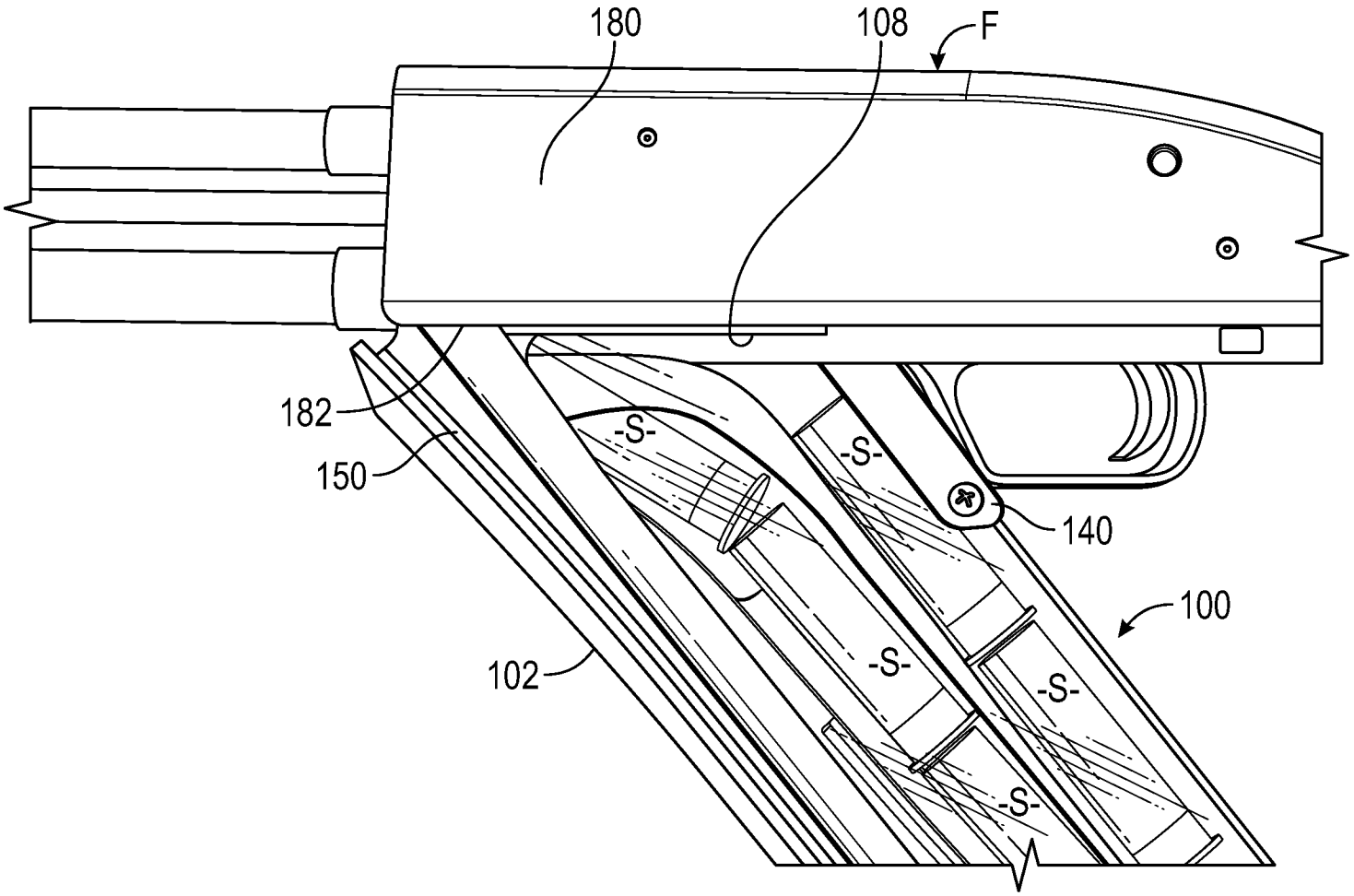
FIG. 4 is a side elevation view showing the shotgun charger of FIG. 1 coupled with a shotgun and ready to receive shotgun shells from the shotgun charger for loading into the shotgun.

After all shells from the area H1 are moved out of the charger 100, the advancing member 116 is retracted in the direction R. When the advancing member 116 reaches the fully retracted position, the diverter 120 is free to be moved, i.e., to the right and past the retracted engagement member 170. The position of the diverter is as shown in FIG. 3, and the direction of the diverter's rightward movement is shown by the arrow L. As can also be seen, the shells S in the second area H2 have been moved laterally to the right by the movement of the diverter 120.

As also shown, the advancing member 116 is positioned with the engagement member 170 aligned with the last shell S of the area H2 in FIG. 3. Thereafter, one or more of the remaining shells S in the charger 100 can be moved out of the charger 100 upon readvancement of the advancing member 116 in the direction A, such as to further load the shotgun F or to empty the charger 100.

Figure 5:
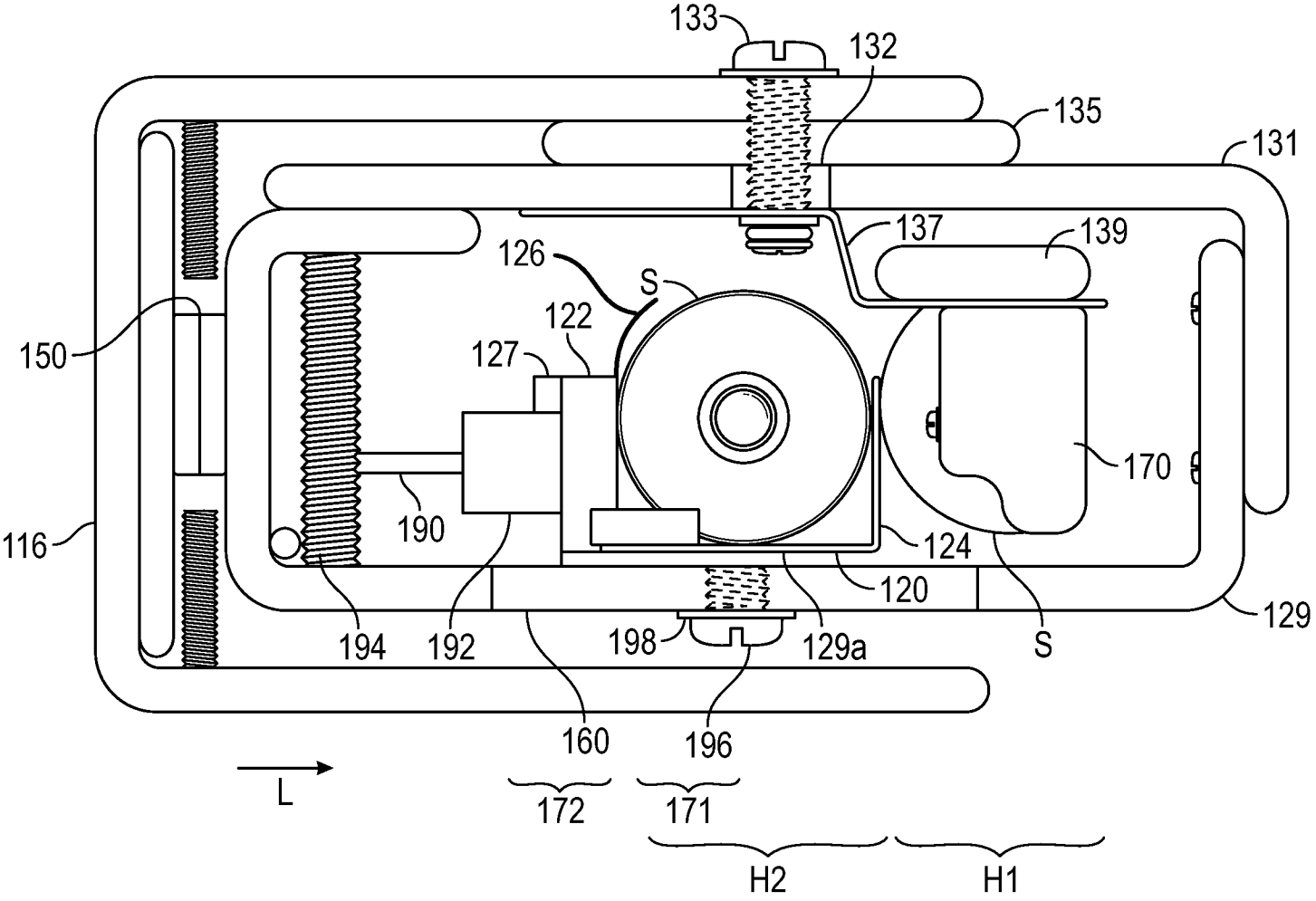
FIG. 5 is an enlarged end view in elevation of a lower end of the shotgun charger of FIG. 1.

Referring to FIG. 5, which is an end view of the charger 100 from the lower end, the internal connection between the advancing member 116 and the engagement member 170 in the illustrated implementation can be described. The advancing member 116 has an aperture formed in its side through which a threaded sleeve 133 (or a similar projecting member) is positioned to extend. As illustrated, the sleeve 133 also extends through an optional spacer member 135 and the slot 132 in the side cover member 131. The inner end of the threaded sleeve 133 terminates at a support plate 137, which is held lightly against an inner side of the side cover member 131. The support plate 137 extends laterally and is coupled to the engagement member 170. An optional guide member 139 may be positioned between the guide plate 137 and the inner surface of the side cover member 131 to help ensure smooth movement of the assembly and prevent binding as the advancing member 116 is advanced and retracted.

The diverter 120 can be biased to move in the direction L. Referring to FIG. 5, the diverter 120 in the illustrated implementation is contacted by a paddle 192 which is supported on a leg of a torsion spring 190. The spring 190 is mounted to a shaft (which is obscured in FIG. 5 by a fastener 194) and is configured to provide a biasing force in the direction L, which tends to keep the diverter 120 positioned as shown (while shells S are still present in the area H1), and then urges the diverter 120 (and the shells S therewithin) to the right when the engagement member 170 is fully retracted, as described above. In addition to the spring 190 and the paddle 192, there can be at least one optional additional spring and paddle arrangement (FIG. 3) at a longitudinally spaced location along the track 150 to ensure proper biasing and smooth movement. In other implementations, alternative biasing members, such as leaf springs, coil springs, V-springs and/or other types of springs can be used.

The diverter 120 can also be configured so that its lateral movement in the direction L and back is keyed to the housing. For example, in the illustrated implementation, the diverter 120 can have a projecting member 196 (e.g., a threaded sleeve, a post, or another type of projection) that extends through the slot 160 in a side member 129. Optionally, there can be a support plate 198 as shown or a washer. The engagement between the projecting member 196 and the slot 160 is designed to keep the diverter 120 aligned with the side member 129 for smooth movement back and forth. Although only one projecting member 196 is shown, there may be at least one additional projecting member at a longitudinally spaced location along the slot 160 to further assist in guiding the diverter 120.

Referring again to FIG. 2, the diverter 120 has a first side 122 and a second side 124. The shells S in the area H1 as shown in FIG. 2 are guided by an inner surface of a rear side of the housing (e.g., a surface of the side member 129), inner side surfaces of the housing (e.g., surfaces of the side member 129 and the side cover member 131) and an outer surface of the second side 124 of the diverter 120. The second side 124 is spaced apart from the first side 122 by a dimension slightly greater than a largest diameter of one of the shells S (e.g., slightly greater than the rim that projects from the base of a shotgun shell). There can also be a plate 126 positioned to extend along a segment 129*a* between the first side 122 and the second side 124, and over at least a portion of the length of the diverter 120 The shells S in the area H2 are guided by the first side 122, a facing surface of the second side 124 and the plate 126 (which together form a channel-like or track-like configuration).

The diverter 120 can be formed from a strip of thin metal stock or another suitable material having sufficient flexibility. The sides of the strip can be upturned to give the diverter 120 a channel-like shape. The first side 122 of the diverter 120 can be fitted with an optional guide 127 that slides along the paddle 192 as the diverter 120 is moved.

The advancing member 116 can be shaped as shown with a gripping portion 118 convenient for holding with one hand during movement of the advancing member. The advancing member 116 can have a U-shaped cross section. The advancing member 116 can be configured to slide along a track 150 formed at a forward side of the body 102.

As stated, the first end 104 can have a receiver insert 108 shaped to be inserted into the receiver 180. The bottom opening 182 in the shotgun receiver 180 is conventionally used to load and unload shotgun shells from the shotgun. (The charger could also be adapted for use with a side opening in a receiver.)

The receiver insert 108 defines an internal recess sized to receive one shell S and position it within the receiver 180, such as in alignment with the magazine. The receiver insert 108 can have a forward end 110 and a rearward end 112. The forward end 110 can include an extension 113 shaped to engage a corresponding lip or recess in the shotgun. The receiver can also include have a retainer, such as a resilient or biased retaining member 114 as shown, that tends to keep the charger 100 engaged with the receiver 180 until the user deliberately pivots the charger 100 away from the receiver 180 to disengage it. The retaining member 114 can be configured to have a loop portion that is resiliently deformable upon engagement with the receiver 180/receiver opening 182 as the charger is pivoted about the forward end 110 into the position shown in FIG. 4.

In the illustrated implementation, the receiver insert 108 can be made of metal and attached to sides of the housing with threaded fasteners 144 extending through tabs 140, 142 on either side. In other implementations, the receiver insert 108 can be formed as part of the housing, without requiring the tabs 140, 142. For example, a receiver insert 108 formed of metal can be smoothly joined to a single-piece or multi-piece housing formed of a plastic material.

Figure 6:
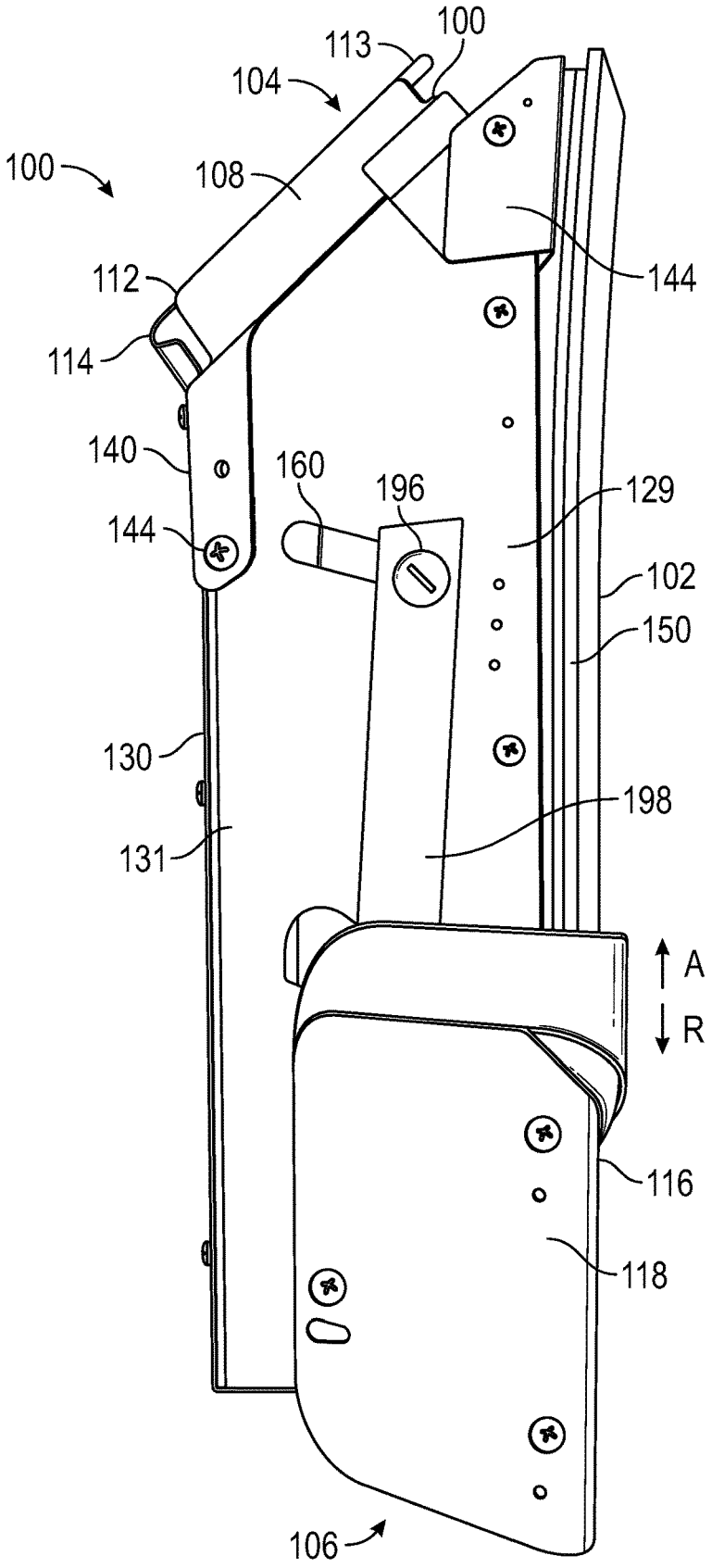
FIG. 6 is an opposite side elevation view of the shotgun charger of FIG. 1.

Referring to FIG. 6, a side elevation view of the charger 100 from the opposite side is shown. In the illustrated implementation, the projecting member 196 that is coupled to the diverter member 120 is accessible. In some implementations, the projecting member 196 can be manually slid with the slot 160 to move the diverter 120, such as in the process of loading the charger 100 with shells S. In other implementations, the external projecting member 196/slot 160 arrangement (including the optional guide plate 198, if present) is instead formed as an equivalent guiding structure internal to the body 102 of the charger 100.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A charger for a firearm, comprising:

a body having defined therein at least first and second cartridge holding areas, the first and second cartridge holding areas being arranged parallel to each other, wherein each of the first and second cartridge holding areas is configured to receive and store cartridges in an end-to-end orientation;

a first end of the body having a cartridge opening through which cartridges can be loaded into and unloaded from the charger, the first end having a receiver insert shaped to fit into a receiver of the firearm;

a movable internal diverter positioned in the body and extending at least partway between the first and second cartridge holding areas to separate the first and second cartridge holding areas from each other; and an advancing member accessible from an exterior of the body, the advancing member having an engaging member extending within the body and configured to contact a cartridge in one of the first and second cartridge holding areas, wherein the advancing member is movable toward the first end in an advancement direction to urge cartridges from a selected one of the first and second cartridge holding areas and out of the cartridge opening and in a reverse direction toward a second end of the body to withdraw the engaging member and move the internal diverter so that the engaging member is aligned with the other of the first and second holding areas.

2. The charger of claim 1, wherein the internal diverter is spring-biased.

3. The charger of claim 1, further comprising at least one torsion spring configured to apply a biasing force to the internal diverter to move the internal diverter when the engagement member is fully retracted.

4. The charger of claim 3, further comprising a contact paddle coupled to the torsion spring and configured to contact the internal diverter.

5. The charger of claim 4, further comprising a guide coupled to the internal diverter, and wherein the guide is configured to guide the internal diverter as the internal diverter is moved relative to the contact paddle.

6. The charger of claim 1, wherein the internal diverter is keyed to the housing for guided movement by at least one projection extending into a slot formed in the housing.

7. The charger of claim 1, wherein the at least one projection is manually actuatable from outside the housing to move the internal diverter.

8. The charger of claim 1, wherein the receiver insert is configured to exert a biasing force to retain the charger in position relative to the receiver of the firearm.

9. The charger of claim 8, wherein the receiver insert comprises a forward end in which the cartridge opening is defined and an opposite rear end fitted with a resilient retainer configured to resiliently deform and provide a holding force.

10. The charger of claim 8, wherein the receiver insert comprises an extension extending from the forward end, and wherein the extension is configured to engage a recess within the firearm.

11. The charger of claim 8, wherein the first end of the receiver insert is shaped to be engaged with a front edge of a bottom opening of the receiver and pivoted rearwardly to move the rear end and resilient retainer into engagement with a rear edge of the receiver opening.

12. The charger of claim 1, wherein the advancing member is configured to be coupled to an exterior of the body.

13. The charger of claim 1, wherein the advancing member is configured to have a first side, a front side and a second side opposite the first side.

14. The charger of claim 13, wherein the advancing member is configured to have a U-shaped cross-section.

15. The charger of claim 1, wherein the body has an external track shaped to receive and guide the advancing member.

16. The charger of claim 1, wherein the first and second cartridge holding areas are dimensioned to hold shotgun shells of a selected shotgun shell gauge.

17. The charger of claim 1, wherein the firearm is a shotgun and the first and second holding areas are configured to hold shotgun shells, and wherein the first and second holding areas define shotgun shell positions along respective first and second loading paths extending at an angle transverse to the receiver.

18. The charger of claim 17, wherein the loading paths curve from a steeper transverse angle near a second end of the body to a shallower transverse angle near the first end of the body.

19. The charger of claim 1, wherein the body has at least one slot, and wherein the advancing member has a projecting member shaped to engage and travel within the slot as the engaging member is moved in the advancement direction and the reverse direction.

20. The charger of claim 1, wherein the body comprises at least one transparent portion to provide a visual inspection area through which a user can view an interior of the charger.

* * * * *